US008659632B2

(12) United States Patent
Tsuchiya et al.

(10) Patent No.: US 8,659,632 B2
(45) Date of Patent: Feb. 25, 2014

(54) THERMAL PRINTER

(75) Inventors: Masahiro Tsuchiya, Tokyo (JP); Yukihiro Mori, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/526,685

(22) Filed: Jun. 19, 2012

(65) Prior Publication Data

US 2012/0327165 A1 Dec. 27, 2012

(30) Foreign Application Priority Data

Jun. 21, 2011 (JP) ..... 2011-137668

(51) Int. Cl.
*B41J 2/325* (2006.01)

(52) U.S. Cl.
USPC ..... 347/220

(58) Field of Classification Search
USPC ..... 347/197, 220; 400/120.16
See application file for complete search history.

(56) References Cited

U.S. PATENT DOCUMENTS 4,527,174 A 7/1985 Fujiwara et al.
6,682,239 B2 * 1/2004 Mori et al. ..... 400/649
6,765,602 B2 * 7/2004 Mori ..... 347/220
7,446,790 B2 * 11/2008 Takabatake ..... 347/220
7,780,367 B2 * 8/2010 Yoshioka ..... 400/120.16
8,189,025 B2 * 5/2012 Mori et al. ..... 347/220
2006/0291933 A1 12/2006 Watanabe et al.
2007/0286659 A1 12/2007 Yamada
2008/0068437 A1 * 3/2008 Hirai ..... 347/220
2008/0068438 A1 * 3/2008 Hirai ..... 347/220
2009/0103963 A1 * 4/2009 Takabatake et al. ..... 400/120.01
2010/0020154 A1 * 1/2010 Takahashi ..... 347/220
2010/0053297 A1 * 3/2010 Yokoyama ..... 347/220
2010/0253759 A1 * 10/2010 Mori et al. ..... 347/220

FOREIGN PATENT DOCUMENTS

JP 2011-056691 3/2011

* cited by examiner

*Primary Examiner* — Huan Tran
(74) *Attorney, Agent, or Firm* — IPUSA, PLLC

(57) ABSTRACT

A thermal printer includes a platen roller, a thermal head, a frame including the thermal head and a side plate, the side plate including a platen roller receiving part configured to detachably support a bearing of the platen roller. The platen roller receiving part includes an open mouth for inserting and pulling out the bearing of the platen roller in a direction perpendicular to an axial direction of the platen roller, and the open mouth includes a protrusion formed on a downstream side in a rotation direction of the platen roller.

6 Claims, 10 Drawing Sheets

THERMAL PRINTER

CROSS-REFERENCE TO RELATED APPLICATIONS

This patent application is based upon and claims the benefit of priority of Japanese Patent Application No. 2011-137668 filed on Jun. 21, 2011, the entire contents of which are incorporated herein by reference.

BACKGROUND OF THE INVENTION

1. Field of the Invention

The present invention relates to a thermal printer.

2. Description of the Related Art

A thermal printer that includes a thermal print part including a thermal head and a platen roller is widely adopted as an attached printer attached to a cash register, a portable terminal device, an ATM (Automated Teller Machine) and the like.

In this kind of thermal printer, a clamshell type thermal printer has an apparatus main body including a frame and an access cover that respectively include modules, and functions as a printer by allowing the modules to be combined in a state of the access cover being closed.

In such a clamshell type printer, for example, a configuration is known where the frame of the apparatus main body and the access cover respectively include a thermal head and a platen roller, and the access cover is fixed by allowing a bearing of the platen roller to be supported by the frame of the main body in a state of the access cover being closed.

According to such a configuration, because the platen roller is attached to the access cover, the platen roller is detached from the main body with the access cover when the access cover is opened, which makes it possible to exchange a print paper sheet and remove a paper jam readily and quickly.

In a conventional example, FIG. 1 is a perspective view showing a main part including a frame that supports a platen roller 51 of a thermal printer 200.

A frame of the thermal printer 200 of the conventional example is made up of a main body 100 and side plates 101 and 102, and further includes a paper guide part 103, a gear case 104 and the like. The main body 100 and the side plates 101 and 102 of the frame are an integral part made of zinc and the like formed by die-casting. The paper guide part 103 and the gear case 104 are molded articles made of resin material, and fitted into the main body 100 or the side plates 101 and 102.

The frame includes a thermal head not shown in the drawing, a head spring 53 to press the thermal head to the platen roller 51, a motor 21 to drive and rotate the platen roller 51 and the like, and detachably supports bearings 5 and 7 of the platen roller 51 by platen roller receiving parts 105 and 106.

The platen roller 51 is, for example, mounted on an access cover not shown in the drawing, with its bearings 5 and 7 inserted into the platen roller receiving parts 106 and 105 of the side plates 101 and 102 of the frame, respectively, and is fixed and supported by a platen roller holding spring 9 at a predetermined force.

FIG. 2 is a main part side view seen from the side plate 102 of the thermal printer 200 of the conventional example. FIG. 2 shows a state of the bearing 7 of the platen roller 51 inserted into the platen roller receiving part 105 of the side plate 102 and fixed by the platen roller holding spring 9.

The platen roller holding spring 9 includes a holding part 9*a* of the bearing 7 of the platen roller 51 and a curved part 9*b* fitted to a convex part 10 provided on the side plate 102. The platen roller holding spring 9 is formed by bending a wire spring made of a metal and the like.

Because the platen roller holding spring 9 can bend in a direction opposite to the axis of the platen roller 51, the platen roller holding spring 9 makes possible attaching and detaching the bearing 7 of the platen roller 51, and fixes and supports the bearing 7 at a certain force when the bearing 7 has been inserted in the platen roller receiving part 105.

The thermal printer 200 of the conventional example makes possible attaching and detaching the platen roller 51 by using the platen roller holding spring 9 as mentioned above. However, because the conventional thermal printer 200 requires the wire spring, a number of parts and labor hours for bending the wire spring and attaching the bended wire spring to the side plate 102 increase, which causes an increase of cost.

FIGS. 3A through 3C are views showing a configuration of the thermal printer 200 including bearings and a gear of the platen roller 51 in the conventional example. FIG. 3A is a plan view of the platen roller 51 to which the bearings 5 and 7, the gear 4, and a washer 6 are attached. FIG. 3B is an exploded perspective view of the respective parts. FIG. 3C is an enlarged view of a shaft part of the platen roller 51 to which the bearing 7 and the washer 6 are attached.

As shown in FIGS. 3A and 3B, the platen roller of the conventional example includes the gear 4 and the bearing 5 on one end, and the bearing 7 and the washer 6 on the other end, and is made up of five parts as a whole.

The bearing 5 is inserted into the platen roller receiving part 106 of the side plate 101 of the frame of the thermal printer 200 shown in FIG. 1, and the bearing 7 is inserted into the platen roller receiving part 105 of the side plate 102 as well, by which the platen roller 51 is fixed and supported rotatably.

As shown in FIGS. 3A and 3B, the bearings 5 and 7 are respectively mounted on shaft ends 11*b* and 11*c*, and are provided to allow the shaft to spin free inside. A shaft end 11*a* of the platen roller 51 having a D-cut shape in cross-section perpendicular to the axial direction of the platen roller 51 is pressed into the gear 4, which drives to rotate the platen roller 51 by receiving a drive force of a motor 21 (which is shown in FIG. 1) through a reduction gear. As shown in FIG. 3C, the bearing 7 is fixed by the washer 6 not to come out after being mounted on the shaft 11*c* of the platen roller 51.

In the thermal printer 200 of the conventional example, the frame that supports the bearings 5 and 7 of the platen roller 51 is formed by die-casting of zinc and the like, and the platen roller holding spring 9 to press the bearings 5 and 7 is formed of the wire spring of a metal material.

Accordingly, if the bearings 5 and 7 are configured to rotate with the revolving platen roller 51, the bearings 5 and 7 are worn away between the platen roller receiving parts 105 and 106, and the platen roller holding spring 9. Hence, the bearings 5 and 7 are required to be fixed and supported by the platen roller parts 105 and 106, and are not to be rotated by the platen roller 51 revolving with the gear 4, which results in increasing a number of parts needed.

FIGS. 4A through 4C show side views of the platen roller 51 and the gear 4 of the conventional example. FIG. 4A is a side view of the platen roller 51. FIG. 4B is a side view of the gear 4. FIG. 4C is a side view of the gear 4 mounted on the shaft 11*a* of the platen roller 51.

As shown in FIG. 4A, in an end of the shaft 11*a* that is inserted into the gear 4 of the platen roller 51, a flat part 12 is formed so that the cross-section perpendicular to the axial direction has a D-cut shape. Moreover, as shown in FIG. 4B, the gear 4 includes a press fit hole 13 that has a flat part 13*a* and a D-cut shape slightly smaller than the cross-section of the shaft 11*a* of the platen roller 51, and the shaft lie of the platen roller 51 is pressed into the press fit hole 13.

In order to fit the shaft 11 of the platen roller 51 into the gear 4 with only the flat part 12 for driving rotation, because there is a concern that the shaft 11*a* may idle if the flat part 12 in cross-section of the shaft end 11*a* is too small, the flat part 12 is required to be a certain size.

Furthermore, in order to press the shaft end 11*a* having the formed flat part 12 into the press fit hole 13 of the gear 4 and to fix the shaft more certainly, the press fit hole 13 also needs the flat part 13*a* corresponding to the flat part 12 of the shaft end lie of the platen roller 51.

As shown in FIG. 4C, when the shaft 11*a* of the platen roller 51 is pressed into the gear 4, the gear 4 and the shaft end 11*a* of the platen roller 51 are fixed at the D-cut surface (i.e., flat part) 12. If the gear 4 is rotated, a force from the gear 4 is transmitted to the ends of the D-cut surface 12, which is shown by dotted lines in the drawing, formed into the shaft end 11*a* of the platen roller 51.

Here, in pressing the shaft end 11*a* of the platen roller 51 into the gear 4, because the shaft end 11*a* is pressed into the gear 4 after the respective flat parts 12 and 13*a* of the shaft 11*a* of the platen roller 51 and the press fit hole 13 of the gear 4 are adjusted to become flat by visual observation using a jig, so that assembly requires a certain number of labor hours.

As mentioned above, the thermal printer 200 requires parts such as the wire spring and the like to support the bearings 5 and 7 of the platen roller 51. In addition, the bearings 5 and 7 that contact the side plates 101 and 102 of the frame made of a metal material must be configured not to be rotated with the platen roller 51, which causes an increase in the numbers of parts and labor hours for production.

For example, Japanese Patent Application Laid-Open Publication No. 2011-56691 discloses a related art example.

SUMMARY OF THE INVENTION

Accordingly, embodiments of the present invention may provide a thermal printer solving or reducing one or more of the above-described problems.

More specifically, the embodiments of the present invention may provide a thermal printer that can reduce cost by decreasing the numbers of parts and production labor hours.

According to an embodiment of the present invention, a thermal printer includes a platen roller, a thermal head, a frame including the thermal head and a side plate, the side plate including a platen roller receiving part configured to detachably support a bearing of the platen roller, wherein the platen roller receiving part includes an open mouth for inserting and pulling out the bearing of the platen roller in a direction perpendicular to an axial direction of the platen roller, and the open mouth includes a protrusion formed on a downstream side in a rotation direction of the platen roller.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given, with reference to the accompanying drawings, of respective embodiments of the present invention.

<Thermal Printer Configuration>

A description is given about a thermal printer of an embodiment hereinafter.

Figure 5B:
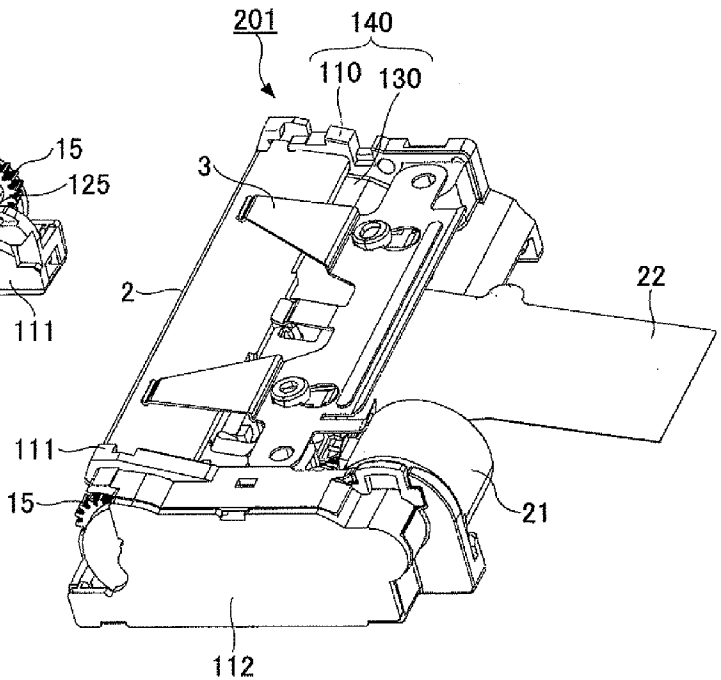
FIGS. 5A and 5B are main part perspective views of a thermal printer of an embodiment.
Figure 5A:
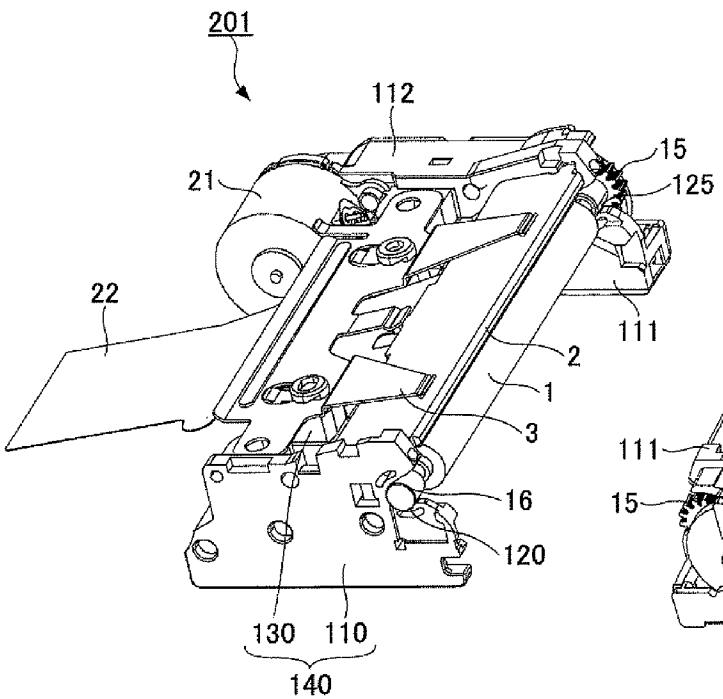

FIGS. 5A and 5B are main part perspective views of a thermal printer 201 of the present embodiment. FIG. 5A is a perspective view seen from the side plate 110 side of a frame 140, and FIG. 5B is a perspective view seen from the side plate 111 side of the frame 140.

The frame 140 is formed including a main body 130 and the side plates 110 and 111 integrally molded with resin material.

A thermal head 2 is supported by the side plates 110 and 111, and pressed toward a platen roller 1 by a head spring 3 attached to the main body 130 of the frame 140.

The platen roller 1 is mounted on an access cover not shown in the drawing. In a state of the access cover being closed, a gear 15 and a bearing 16 are provided at respective ends of the platen roller 1 and are detachably supported by platen roller receiving parts 120 and 125 that are formed in the respective side plates 110 and 111.

Moreover, a motor 21 is fitted inside the side plate 111 of the frame 140. When the motor 21 drives, the gear 15 of the platen roller 1 rotates by way of a reduction gear provided in a gear case 112 but not shown in the drawing.

The platen roller 1 rotates by receiving the torque of the motor 21, and conveys a paper sheet not shown in the drawing wrapped around the platen roller 1. The thermal head 2 performs printing on the paper sheet at a space with the platen roller 1. Data to be printed are sent from a control substrate not shown in the drawing to the thermal head 2 through a flexible printed wiring board 22.

<Platen Roller Receiving Part Configuration>

Figure 6B:
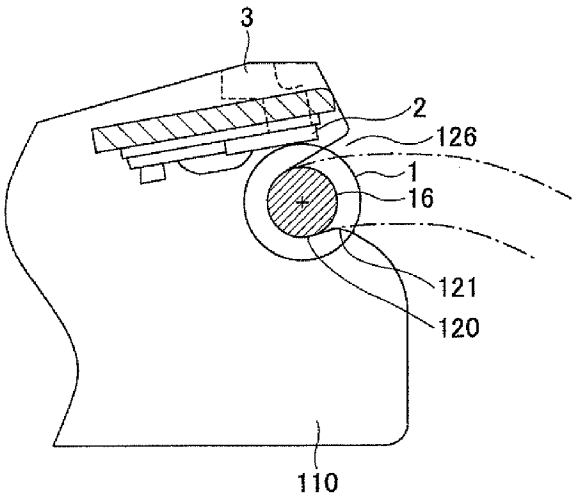
FIGS. 6A and 6B are explanatory drawings of a platen roller receiving part of the thermal printer of the embodiment.
Figure 6A:
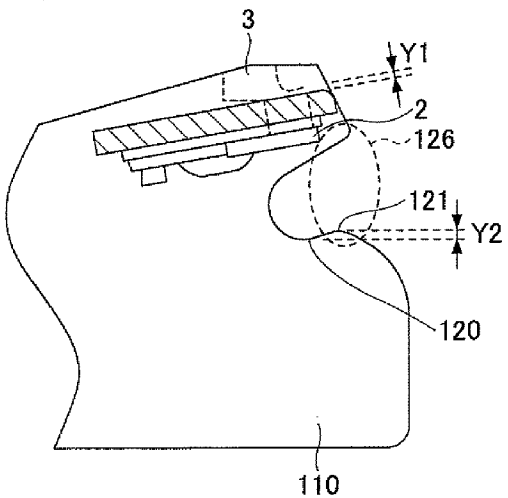

FIGS. 6A and 6B are explanatory drawings of the platen roller receiving part 120 of the side plate 110 of the frame of the thermal printer 201. FIG. 6A shows a state where the platen roller receiving part 120 does not support the bearing 16 of the platen roller 1. FIG. 6B shows a state where the platen roller receiving part 120 supports the bearing 16 of the platen roller 1.

The platen roller receiving part 120 provided in the side plate 110, as shown in FIG. 6A, includes an open mouth 126 for inserting and pulling out the bearing 16 of the platen roller 1 in a direction perpendicular to the axial direction of the platen roller 1.

As shown in FIG. 6B, the bearing 16 of the platen roller 1 is supported by being inserted from the open mouth 126 into the platen roller receiving part 120 along dashed lines in the drawing. The platen roller 1 rotates in a clockwise direction in a state of the bearing 16 being supported by the platen roller receiving part 120 by receiving the torque of the motor 21.

On the lower side of the open mouth 126 of the platen roller receiving part 120, a protrusion 121 is formed on the downstream side in the rotation direction of the platen roller 1, and prevents the bearing 16 from deviating from the platen roller receiving part 120 caused by the rotation of the platen roller 1.

The thermal head 2 is pressed to the platen roller 1 by a head spring 3, but is provided so as to move only a distance Y1 opposite to the axis of the platen roller 1. In inserting the bearing 16 of the platen roller 1 into the platen roller receiving part 120, by allowing the thermal head 2 to move toward the opposite side by being pushed, the bearing 16 of the platen roller 1 gets over the protrusion 121 of the open mouth 126 and is inserted into the platen roller receiving part 120.

If a height of the protrusion 121 from the bottom surface of the platen roller receiving part 120 is made to be Y2, when the height Y2 is too large relative to the movable distance Y1 of the thermal head 2, inserting and pulling of the bearing 16 becomes difficult. Furthermore, if the Y2 is too small relative to the Y1, the bearing 16 may deviate from the platen roller receiving part 120 accompanied by the rotation of the platen roller 1, which is not preferable.

The height Y2 of the protrusion 121 is preferably larger than the movable distance Y1 of the thermal head 2 and more specifically twice the size of the movable distance Y1 or less so that the bearing 16 can be inserted into and pulled out of the platen roller receiving part 120, without causing the deviation of the bearing 16 from the platen roller receiving part 120 by the rotation of the platen roller 1 while the platen roller 1 is rotated.

In addition, the description has been given about the platen roller receiving part 120 of the side plate 110 of the frame, but the platen roller receiving part 125 having a similar protrusion is formed in the side plate 111 on the opposite side, which can detachably support a bearing part holding the gear 15 of the platen roller 1.

In the thermal printer 201 of the present embodiment, the side plates 110 and 111 of the frame 140 detachably support the platen roller 1 by the above mentioned platen roller receiving parts 120 and 125. Due to this, the platen roller wire spring used in the thermal printer of the conventional example is unnecessary, which reduces the number of parts, and makes it possible to lower cost by reducing the number of labor hours for processing the wire spring and installing the processed wire spring.

Figure 7B:
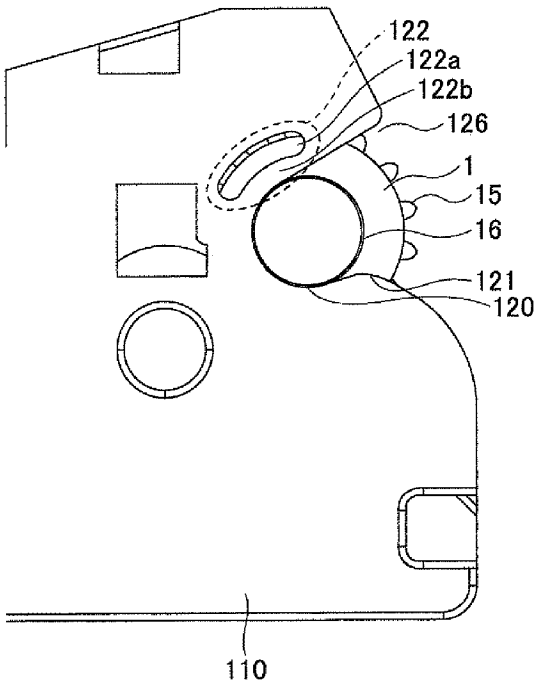
FIGS. 7A and 7B are views showing other configurations of a side plate of a frame supporting a bearing of a platen roller of an embodiment.
Figure 7A:
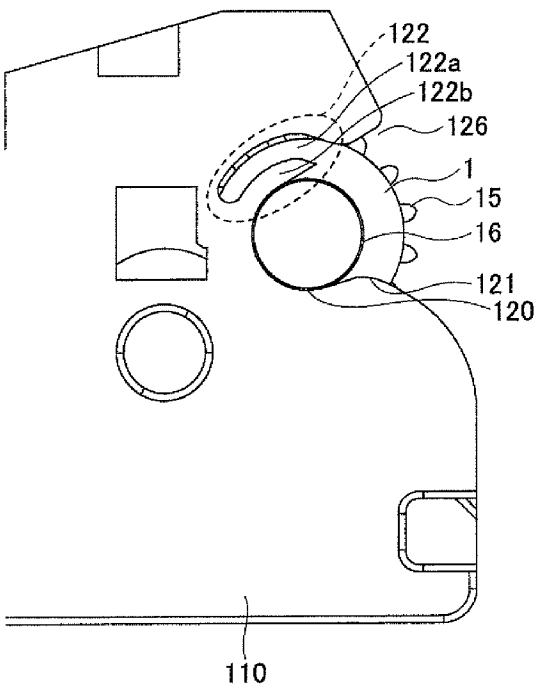

FIGS. 7A and 7B show other configuration examples of the side plate 110 that supports the bearing 16 of the platen roller 1. FIGS. 7A and 7B show a state of the bearing 16 of the platen roller 1 being supported by the platen roller receiving part 120 of the side plate 110 of the frame 140.

The thermal head 2 is pressed by the head spring 3 by a structure similar to FIGS. 6A and 6B, and the platen roller 1 rotates in the clockwise direction in the drawing by receiving the torque of the motor 21. Moreover, the open mouth 126 is formed in the direction perpendicular to the axial direction of the platen roller 1 in the platen roller receiving part 120, and the protrusion 121 is formed on the downstream side of the rotation direction of the platen roller 1.

As shown in FIG. 7A, the side plate 110 of the frame includes a spring part 122 in which a gap 122*a* is formed, around the platen roller receiving part 120. In the spring part 122 formed in the side plate 110 of the frame 140, when the bearing 16 of the platen roller 1 is inserted into the platen roller receiving part 120, the gap 122*a* is pushed and deformed, and a beam part 122*b* presses and supports the bearing 16.

The side plate 110 of the frame includes the spring part 122 formed having the deformable gap 122*a* curved around the upper part of the platen roller receiving part 120, and the spring part 122 presses and supports the bearing 16, by which the bearing 16 of the platen roller 1 can be more effectively supported.

Moreover, as shown in FIG. 7B, the gap 122*a* can be formed as a closed area in the side plate 110 of the frame 140. Furthermore, it is possible to form the spring part 122 including the gap 122*a* at a different location around the platen roller receiving part 120.

Figure 8:
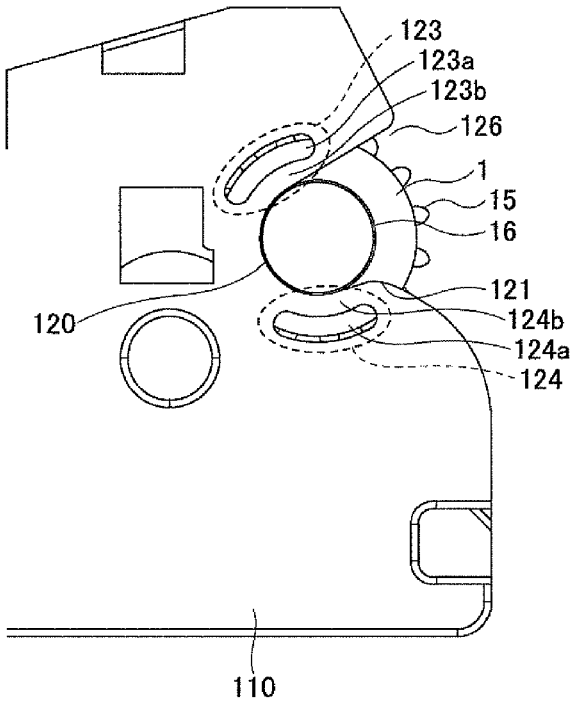
FIG. 8 is a view showing another configuration of a side plate of a frame supporting a bearing of a platen roller of an embodiment.

FIG. 8 shows another configuration example of the side plate 110 of the frame 140 that supports the bearing 16 of the platen roller 1. FIG. 8 shows a state of the bearing 16 of the platen roller 1 being supported by the platen roller receiving part 120 of the side plate 110 of the frame 140.

In an example shown in FIG. 8, the side plate 110 of the frame 140 includes two spring parts 123 and 124 in which deformable gaps 123*a* and 124*a* are formed, around the platen roller receiving part 120. When the bearing 16 of the platen roller 1 is inserted into the platen roller receiving part 120, the respective gaps 123*a* and 124*a* of the spring parts 123 and 124 are pressed and deformed, and beam parts 123*b* and 124*b* press and support the bearing 16 so as to sandwich the bearing 16.

In this manner, the side plate 110 of the frame 140 includes the plural spring parts 123 and 124 including the deformable gaps 123*a* and 124*a* around the platen roller receiving part 120, by which the bearing 16 of the platen roller 1 can be more effectively supported.

Here, the description has been given about the examples of forming two spring parts 123 and 124 in the side plate 110 of the frame 140, but more than two spring parts can be formed. A number and a size of the spring parts 123 and 124 can be set so as to press and support the bearing 16 in a range where the bearing 16 that rotates with the platen roller 1 does not deviate from the platen roller receiving part 120 and yet the bearing 16 is detachable.

The configuration of supporting the bearing 16 of the platen roller 1 by the side plate 110 of the frame 140, as shown in FIGS. 7 and 8, may be formed in the side plate 111 on the opposite side, by which the bearing 16 of the platen roller 1 can be more certainly supported.

<Configuration of Bearing and Gear of Platen Roller>

Figure 9A:
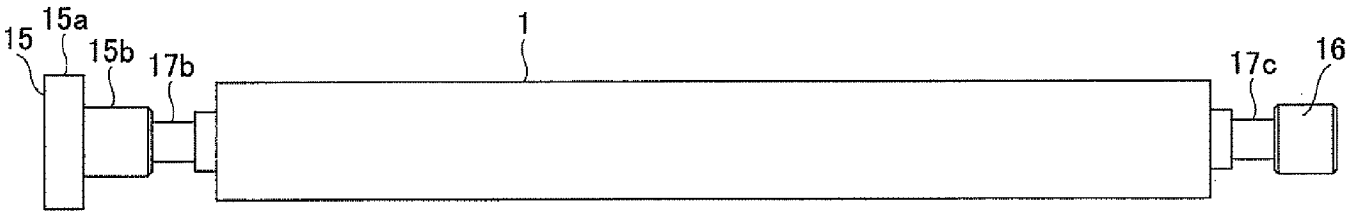
FIGS. 9A and 9B are views showing a configuration example of a platen roller including a bearing and a gear of an embodiment.
Figure 9B:
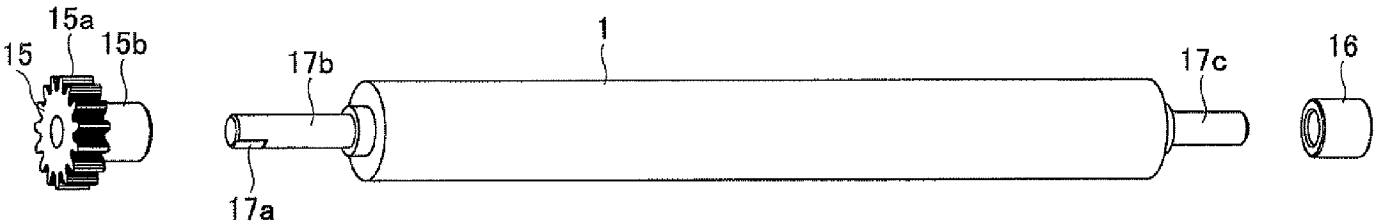

FIGS. 9A and 9B show a configuration of the platen roller 1 including the bearing 16 and the gear 15 of the thermal printer 201 of the present embodiment. FIG. 9A is a plan view of the platen roller 1 to which the bearing 16 and the gear 15 are attached, and FIG. 9B is an exploded perspective view of respective parts.

In FIG. 9A, one shaft end 17*b* of the platen roller 1 is pressed into the gear 15, and the other shaft end 17*c* is pressed into the bearing 16 (shaft bearing).

In the thermal printer 201 of the present embodiment, the frame 140 is integrally formed of resin material including the side plates 110 and 111, and metal parts and the like are not used for the platen roller receiving parts 120 and 125 which the shaft bearings of the platen roller 1 contact.

Accordingly, even if the shaft of the platen roller 1 is pressed into the bearing 16 formed of the resin material to be fixed, and the shaft bearing is configured to be rotated with the platen roller 1 in a state of being supported by the platen roller receiving parts 120 and 125, the shaft bearing is not worn away in itself.

Hence, by adopting a configuration where one shaft bearing is integrally formed with the gear 15 and the shaft end 17*b* of the platen roller 1 is pressed into the shaft bearing (i.e., gear 15) to be fixed, and the shaft end 17*c* of the platen roller 1 is also pressed into the bearing 16 (the other shaft bearing) to be fixed, there is no need to configure a gear and a bearing as individual parts and to use a washer to fix the bearing as in the conventional example, which makes it possible to reduce the number of parts and the cost.

Figure 10A:
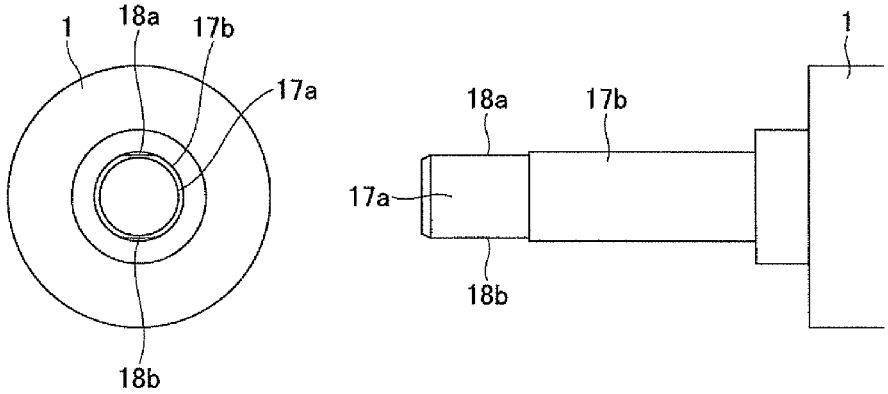
FIGS. 10A through 10C are side views showing a platen roller and a gear of an embodiment.
Figure 10B:
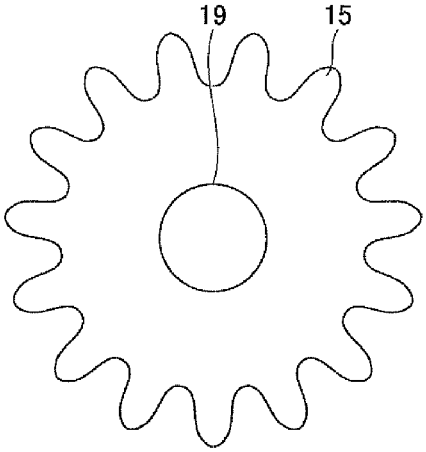
Figure 10C:
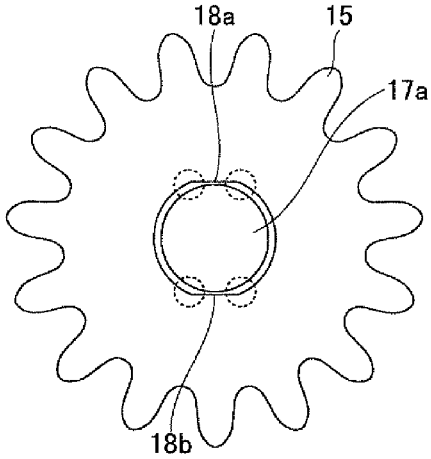

FIGS. 10A through 10C show side views of the platen roller 1 and the gear 15.

As shown in FIG. 10A, in a shaft end 17*a* of the platen roller 1, two flat parts 18*a* and 18*b* are formed in cross-section perpendicular to the axial direction of the platen roller 1. As shown in FIG. 10B, a press fit hole 19 into which the shaft end 17*a* of the platen roller 1 is inserted is formed in the gear 15. A flat part having the same shape as the cross-section of the shaft end 17*a* of the platen roller 1 need not be preliminarily provided in the press fit hole 19, and the press fit hole 19 is formed into a circular shape with a diameter slightly less than that of the shaft end 17*a*.

As shown in FIG. 100, when the shaft end 17*a* of the platen roller 1 is pressed into the press fit hole 19 of the gear 15, the press fit hole 19 becomes a shape along the cross-section perpendicular to the axial direction of the shaft end 17*a* by being pushed out and expanded, where the flat parts 18*a* and 18*b* are formed. If the gear 15 is rotated, the platen roller 1 is also rotated with the gear 15, by allowing respective four end points of the flat parts 18*a* and 18*b* shown by dashed lines in the drawing, to receive the drive force from the gear 15.

In this way, the flat parts 18*a* and 18*b* smaller than the flat parts of the D--cut shape of the conventional example are formed in the shaft end 17*a* of the platen roller 1 to be inserted into the gear 15. If the flat part to engage the gear 15 is small, there is a concern that the platen roller 1 may idle, but forming the plural flat parts 18*a* and 18*b* prevents the shaft end 17*a* of the platen roller 1 from idling.

Moreover, the press fit hole 19 of the gear 15 is formed into a circular shape. By allowing the shaft end 17*a* of the platen roller 1 to be inserted into the press fit hole 19, the press fit hole 19 is formed into a shape along the flat parts 18*a* and 18*b* of the shaft end 17*a*, and engages and rotates with the shaft end 17*a*.

Figure 1:
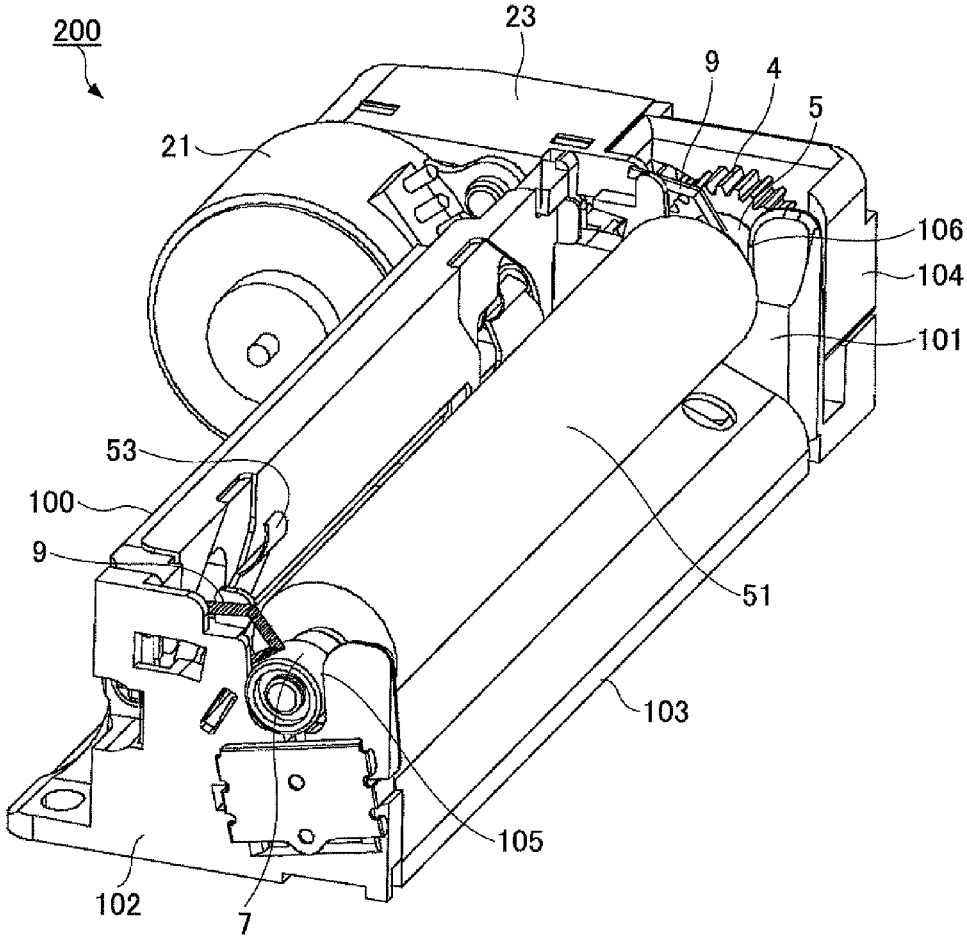
FIG. 1 is a main part perspective view of a thermal printer of a conventional example.
Figure 2:
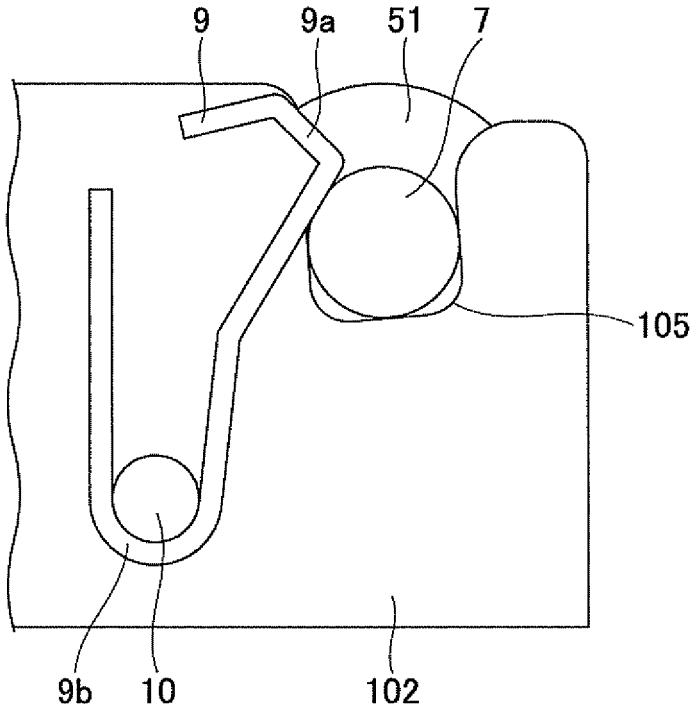
FIG. 2 is a main part side view of the thermal printer of the conventional example.
Figure 3A:
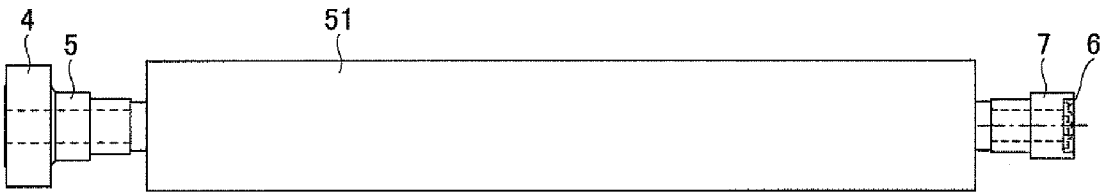
FIGS. 3A through 3C are views showing a configuration of a platen roller including bearings and gears of the conventional example.
Figure 3B:
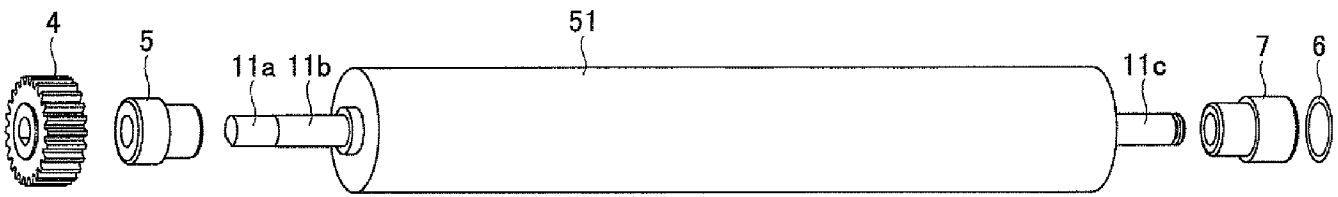
Figure 3C:
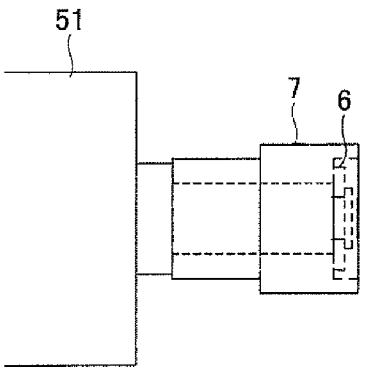
Figure 4A:
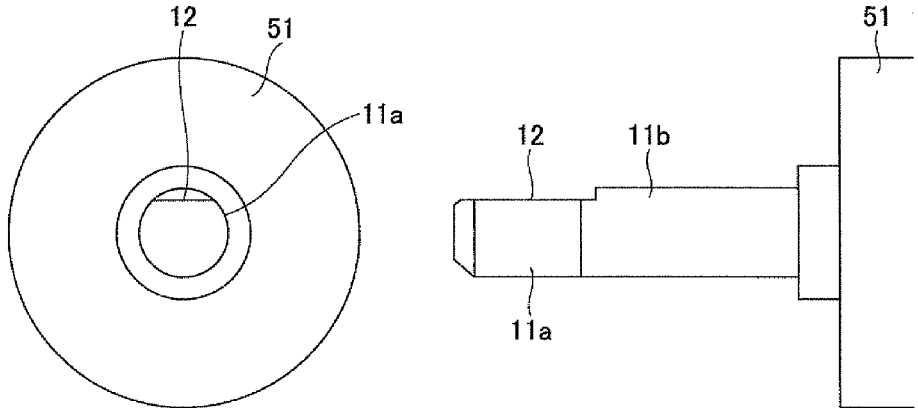
FIGS. 4A through 4C are side views of the platen roller and the gear of the conventional example.
Figure 4B:
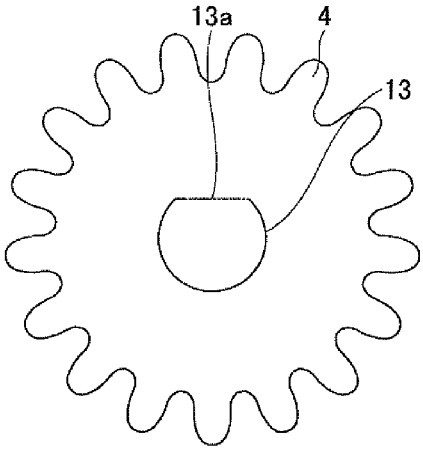
Figure 4C:
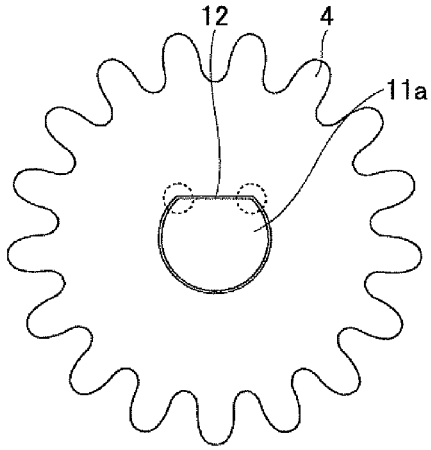

Hence, in inserting the shaft end 17*a* of the platen roller 1 into the press fit hole 19 of the gear 15, it is not required to press a shaft into a gear so as to fit the D-cut surfaces to each other by visual observation as in the conventional example shown in FIGS. 4A through 4C, which makes it possible to reduce the number of labor hours required for assembly.

Furthermore, because the side plates 110 and 111 of the frame 140 are formed of resin material, and metal material and the like are not used for the platen roller receiving parts 120 and 125, the shaft bearing formed of the resin material is not worn away when rotating with the platen roller 1. Accordingly, it is possible to form one bearing shaft integrally with the gear 15 so as to mount the gear 15 on the shaft end 17*a* by press fitting, and form the other bearing shaft by mounting the bearing 16 on the shaft end 17*c* by press fitting similarly, which can reduce cost by reducing the number of parts.

<Conclusion>

According to the embodiments of the present invention, the platen roller receiving parts 120 and 125 provided in the side plates 110 and 111 of the frame 140 include open mouths 126 to attach and detach the shaft bearings of the platen roller 1, and the protrusions 121 are formed on the downstream side in the rotation direction of the platen roller 1, by which the platen roller 1 can be supported detachably without adding a platen roller holding spring and the like.

Therefore, another part to support the platen roller 1 such as a wire spring and the like is not needed, which makes it possible to reduce the number of parts and to support the platen roller certainly.

In addition, by forming the spring part 122 and the like including the deformable gap 122*a* around the platen roller receiving parts 120 and 125 of the side plates 110 and 111 of the frame 140, the shaft bearings of the platen roller 1 can be more certainly supported.

Moreover, because the side plates 110 and 111 including the platen roller receiving parts 120 and 125 are formed of resin material, one of the shaft bearings of the platen roller 1 formed of the resin material can be formed integrated with the gear 15 mounted on the shaft end 17*a* of the platen roller 1 so as to rotate with the platen roller 1. Furthermore, by forming the plural flat parts 18*a* and 18*b* in the cross-section perpendicular to the axial direction in the shaft end part to be pressed into the gear 15, and by pressing the shaft end part into the gear 15, reducing a number of man-hours is possible, which can contribute to the cost reduction.

In this manner, according to the embodiments of the present invention, it is possible to provide a thermal printer to be able to reduce cost and to detachably support the platen roller by the frame without increasing the number of parts and production man-hours.

More specifically, according to the embodiments of the present invention, it is possible to provide a thermal printer to be able to reduce the number of parts and man-hours for production, to reduce the cost, and to allow the frame to certainly support the shaft of the platen roller of the frame.

The thermal printer according to the embodiments has been described above. All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention. Although the thermal printer in accordance with the embodiments of the present invention have been described in detail, it should be understood that the various changes, substitutions, alterations and combinations with other components could be made hereto without departing from the spirit and scope of the invention, which may be properly determined depending on the application form.

What is claimed is:

1. A thermal printer, comprising:

a platen roller;

a thermal head; and a frame including the thermal head, a side plate, the side plate including a platen roller receiving part configured to detachably support a bearing of the platen roller provided at a top portion of the side frame, and a bottom surface provided below the platen roller receiving part, wherein the platen roller receiving part includes an open mouth for inserting and pulling out the bearing of the platen roller in a direction perpendicular to an axial direction of the platen roller, and wherein the open mouth includes a protrusion which projects toward the top portion from the bottom surface.

2. The thermal printer as claimed in claim 1, wherein the side plate of the frame includes at least one spring part formed including a deformable gap around the platen roller receiving part, and the spring part configured to presses and supports the bearing of the platen roller.

3. The thermal printer as claimed in claim 2, wherein the side plate of the frame includes plural of the spring parts.

4. The thermal printer as claimed in claim 1, wherein the bearing is integrally fanned with a gear to rotate the platen roller.

5. The thermal printer as claimed in claim 2, wherein the frame is formed of resin material.

6. The thermal printer as claimed in claim 4, wherein an end of a shaft on the gear side of the platen roller includes plural flat parts in cross-section perpendicular to the axial direction, and is pressed into the gear to rotate the platen roller.

* * * * *